United States Patent [19]

Feder et al.

[11] 4,152,248

[45] May 1, 1979

[54] HYDROGENATION OF COAL LIQUID UTILIZING A METAL CARBONYL CATALYST

[75] Inventors: Harold M. Feder, Hinsdale; Jerome W. Rathke, Bolingbrook, both of Ill.

[73] Assignee: The United States of America as represented by the United States Department of Energy, Washington, D.C.

[21] Appl. No.: 902,182

[22] Filed: May 2, 1978

[51] Int. Cl.[2] ..... C10G 23/02

[52] U.S. Cl. ..... 208/144

[58] Field of Search ..... 208/143, 144, 10

[56] References Cited

U.S. PATENT DOCUMENTS

| | | | |
|---|---|---|---|
| 2,756,194 | 7/1956 | Mayland | 208/10 |
| 2,841,617 | 7/1958 | Mertzweiller | 260/604 |
| 3,184,401 | 5/1965 | Gorin | 208/144 |
| 3,505,204 | 4/1970 | Hoffman | 208/10 |
| 3,694,342 | 9/1972 | Sprow et al. | 208/10 |

OTHER PUBLICATIONS

"Fossil Energy Research Program" ERDA Report No. 77-33, Apr. 1977.

*Primary Examiner*—George Crasanakis

*Attorney, Agent, or Firm*—Dean E. Carlson; Frank H. Jackson

[57] ABSTRACT

Coal liquid having a dissolved transition metal, catalyst as a carbonyl complex such as $Co_2(CO_8)$ is hydrogenated with hydrogen gas or a hydrogen donor. A dissociating solvent contacts the coal liquid during hydrogenation to form an immiscible liquid mixture at a high carbon monoxide pressure. The dissociating solvent, e.g. ethylene glycol, is of moderate coordinating ability, while sufficiently polar to solvate the transition metal as a complex cation along with a transition metal, carbonyl anion in solution at a decreased carbon monoxide pressure. The carbon monoxide pressure is reduced and the liquids are separated to recover the hydrogenated coal liquid as product. The dissociating solvent with the catalyst in ionized form is recycled to the hydrogenation step at the elevated carbon monoxide pressure for reforming the catalyst complex within fresh coal liquid.

10 Claims, 1 Drawing Figure

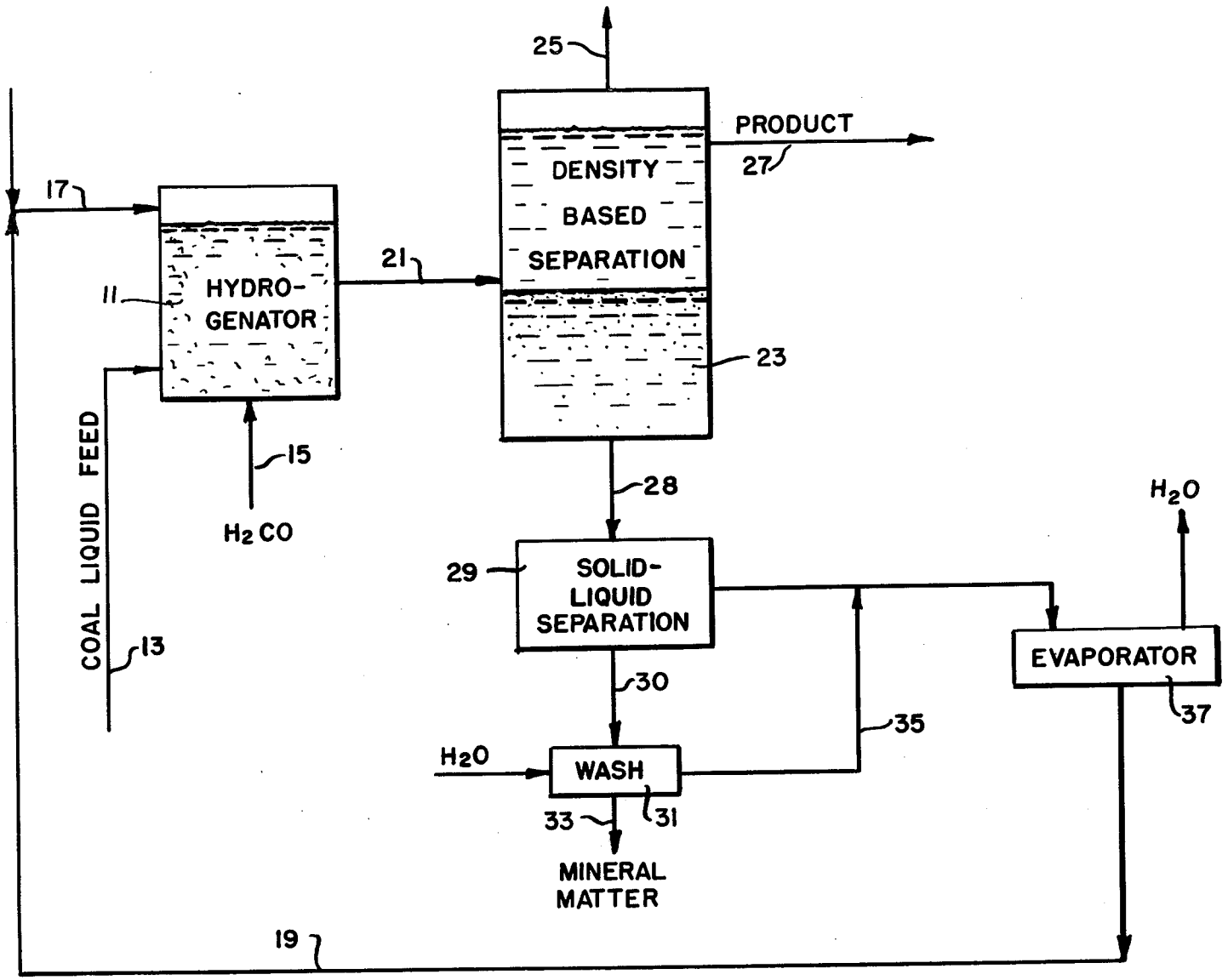
HYDRO-GENATOR
11
15
$H_2CO$
13
COAL LIQUID FEED
17
21
DENSITY BASED SEPARATION
23
PRODUCT
27
25
28
SOLID-LIQUID SEPARATION
29
30
WASH
31
33
MINERAL MATTER
$H_2O$
35
EVAPORATOR
37
$H_2O$
19

HYDROGENATION OF COAL LIQUID UTILIZING A METAL CARBONYL CATALYST

CONTRACTUAL ORIGIN OF THE INVENTION

The invention described herein was made in the course of, or under, a contract with the UNITED STATES DEPARTMENT OF ENERGY.

BACKGROUND OF THE INVENTION

The present invention relates to methods of hydrogenating liquid-coal intermediates and products such as those produced in conventional coal liquefaction processes and solvent refined coal processes. For purposes of this application the term "coal liquid" is intended to include carbonaceous liquids derived from anthracite, bituminous, and lignite coal as well as similar liquids from peat, oil shale, tar sand, wood, lignin, solid petroleum residuals and other related materials.

The coal liquids produced by well-known coal liquefaction processes include a mixture of aromatic compounds including but not limited to benzene, naphthalene, anthracene, methylindan, decalin and derivatives of these compounds. Tars, bitumens, asphaltenes, other higher boiling compounds and ash may also be included. It is desirable to further hydrogenate these coal liquids and separate them from solid materials to make them suitable for use as fuel oils and feed stock for the production of refined fuels.

Previous methods for hydrogenating and liquefying coal and coal liquids have included the use of heterogeneous catalysts. Solid catalysts including compounds of cobalt, iron, nickel, molybdenum or tungsten deposited on silico-aluminates or other appropriate supports are contacted with the coal liquid in the presence of hydrogen or a suitable hydrogen donor in solution. Molten salts such as zinc chloride also are employed as catalysts. Such heterogeneous systems must include sufficient reaction surfaces available to both the hydrogen and the coal liquid to allow the reaction to proceed at an acceptable rate. Much more intimate contact is possible with homogeneous systems in which the catalyst is dissolved within the liquid undergoing hydrogenation. However, in the homogeneous systems, the separation of product and catalyst has been an extremely difficult problem.

PRIOR ART STATEMENT

The following publications relate to the technical field of the subject invention but do not disclose or make obvious the invention as claimed.

ERDA-77-33, *Fossil Energy Research Program of the Energy Research and Development Administration FY* 1978, pages 33–47. This report briefly describes a number of processes for the liquefaction and hydrogenation of coal and coal liquids. Many of these processes, such as the H-coal, synthoil and zinc chloride process, employ solid or molten salt catalysts in contact with coal liquids. Others employ solvents for extracting hydrocarbons from the coal, such as the solvent refined coal (SRC), solvent extraction of lignite and the COSTEAM processes. In none of these is a homogeneous catalyst employed which is separated from the product in the manner described herein.

Mertzweiller, U.S. Pat. No. 2,841,617, 1 July 1958. This patent describes a decobalting method for use with the Oxo process for the production of aldehydes from olefins reacted with carbon monoxide and hydrogen.

Decobalting is achieved by converting cobalt hydrocarbonyl to its water-soluble cobalt compound, $Co(Co(CO)_4)_2$ by reaction with a concentrated aqueous solution of cobaltous ions.

Neither of these references disclose the novel coal liquid hydrogenation process summarized below.

SUMMARY OF THE INVENTION

It is an object of the present invention to provide a method of hydrogenating a coal liquid through use of a transition metal catalyst dissolved as a complex molecule within the coal liquid.

It is also an object to provide a coal liquid hydrogenation method in which the homogeneous catalyst is conveniently separated and recovered from the product liquid.

It is a further object to provide a coal liquid hydrogenation method in which solid mineral matter is separated from the product.

In accordance with the present invention, coal liquid having a dissolved transition metal catalyst as a carbonyl complex is hydrogenated with hydrogen gas in the presence of a relatively high partial pressure of carbon monoxide. During hydrogenation, the coal liquid is contacted with an immiscible, dissociating solvent selected from one of the hydroxylic liquids including ethylene glycol, propylene glycol, diethanolamine, triethanolamine and mixtures of these liquids. These dissociating solvents are of moderate coordinating ability while sufficiently polar to solvate the transition metal and form ions when the carbon monoxide partial pressure is reduced to a level substantially lower than that occuring during hydrogenation. The ionized form of the catalyst is extracted into the dissociating solvent which can be separated from the hydrogenated coal liquid. The hydrogenated coal liquid is removed as product and the dissociating solvent including the dissolved catalyst is recycled into immiscible mixture with fresh coal liquid at the higher partial pressure of carbon monoxide. The catalyst is reformed into the complex molecule of the transition metal carbonyl in solution within the coal liquid to again function as a homogeneous hydrogenation catalyst.

In other more specific aspects of the invention, the dissociating solvent is ethylene glycol and ethylene glycol-water mixtures having up to 20% by weight water. The catalyst is dicobalt octacarbonyl as a complex molecule dissolved in the coal liquid and a solvated cobaltous cation along with tetracarbonyl cobaltate anion dissolved within the glycol. Also, the inventors have found that this combination of glycol and catalyst preferentially sweeps mineral matter including ash and other solid particles from the coal liquid into the glycol phase to permit their separation from the product.

BRIEF DESCRIPTION OF THE DRAWINGS

The present invention is illustrated in the FIGURE which is a diagrammatic illustration of a coal liquid hydrogenation process.

DETAILED DESCRIPTION OF THE INVENTION

In the FIGURE a hydrogenator 11 is fed with a coal liquid 13 and a hydrogen and carbon monoxide gas mixture 15. In addition, a solvent 17 including a recycle stream 19 which contains recovered catalyst is fed into the hydrogenator.

Hydrogenator 11 is basically a reactor in which hydrogen is brought into contact with coal liquid including a dissolved catalyst. The catalyst is transferred to the coal liquid from the solvent 17 as the two immiscible liquids are intimately mixed within the hydrogenator 11. For these purposes, hydrogenator 11 can be an agitated vessel for suitably mixing the immiscible liquids and the gases in intimate contact. Other unit operations and equipment such as packed liquid-gas contacting towers or baffled flow-through chambers as well as various other known liquid-liquid and liquid-gas contactors can be employed as hydrogenator 11.

The mixture of hydrogenated coal liquid, solvent and entrained gases are passed to a separator 23 maintained at a lower temperature than the hydrogenator 11. As an example, the hydrogenator may be operated at about 200°-230° C. while separator 23 is cooled to about 100°-130° C. to enhance separation of the various streams. Cooling can be achieved by heat exchange communication between the mixture 21 and other process streams such as recycle 19 as well as outside coolant flows.

Within separator 23, the entrained gases and two different liquid phases are separated into their respective flows with the solid mineral matter passing into the solvent phase. The gases are withdrawn at 25 to provide a substantially reduced partial pressure of carbon monoxide and thereby shift the catalyst from the hydrogenated coal liquid to the solvent. The vented gases at 25 can be treated by conventional methods to adjust the various component concentrations, e.g. those of CO, $H_2$, $H_2S$, $NH_3$ and $CO_2$. The gas flow can then be compressed to the hydrogenator for use with the entering $H_2$, CO flow at 15.

The hydrogenated coal liquid is removed as product at 27 and the dissociating solvent containing the catalyst and solid mineral matter, e.g. ash, is treated and recycled at 19 to the hydrogenator 11. A portion of product 27 may also be recycled to the coal liquid feed 13 to reduce density and viscosity of the feed. The solvent is withdrawn from separator 23 at 28 and passed to a solid-liquid separation unit 29, such as a filter or centrifuge, for removing solid mineral matter 30. The mineral matter is washed at 31 with water and removed from the process at 33. The resulting solvent and wash water mixture 35 is combined with the solvent flow and fed to a suitable evaporator 37 where the solvent is concentrated by water evaporation prior to recycle at 19 to the hydrogenator.

Since the dissociating solvent and catalyst are recycled to hydrogenator 11, only small amounts to make up for losses will need to be added after the initial charge. The catalyst can be added into either the coal liquid or the solvent as the complex molecule or the ionic form. Other forms such as an acetate salt of, for instance, cobalt may also be a suitable form for providing the catalyst.

The process equipment employed in implementing the separations portion of the present method are well-known conventional unit operation components. Separator 23 can be a settling tank or a decanter for permitting gravity separation of the immiscible liquids and solids. Other known operations such as a liquid centrifuge can also be used. Suitable and well-known pressure-regulating devices and compressors are used to ensure that the partial pressure of carbon monoxide within separator 23 is substantially less than that within reactor 11.

Washer 31 for removing adherent liquid from mineral matter 33 and evaporator 37 are well-known chemical engineering unit operations. For instance, the washing can be performed in a suitably drained trough or container and the evaporator can be a single-stage unit or a stripping column.

Coal liquid 13 is one that has been prepared through processes such as solvent extraction of coal or other carbonaceous solids, or through preliminary hydrogenation and liquefaction processes. This liquid includes high-boiling and high-molecular-weight cyclic aromatic materials that can be substantially upgraded in terms of lower viscosity, lower density, lower boiling point and improved burning characteristics through hydrogenation. Various aromatic liquids such as benzene, naphthalene, anthracene, pyrene, perylene, benzothiophene quinoline and the derivatives of these polycyclic compounds may be present. In addition, high-molecular-weight coal tars, bitumens, asphaltenes, coal particles and ash may be in the coal liquid feed.

The hydrogen and carbon monoxide gas stream 15 can be obtained conveniently from the product of a coal gasification process. Consequently, other gases such as methane, nitrogen, oxygen and carbon dioxide may be included. This gas flow will ordinarily include about 20 to 50% hydrogen and about 20 to 60% carbon monoxide by volume. The carbon monoxide will generally be in excess or about 1 to 1.6 times that of the hydrogen.

As will be seen, the carbon monoxide partial pressure is maintained at a high level within hydrogenator 11 in comparison to that in separator 23. For example, a carbon monoxide partial pressure of 10 to 50 MPa (mega pascal) may be present in the hydrogenator, while only 50 to 500 kPa (kilo pascal) pressure is employed in separator 23. Preferably a carbon monoxide partial pressure of at least 15 MPa is used in the hydrogenator.

Solvent 17 is a dissociating solvent that is a hydroxylic liquid capable of dissociating the catalyst used in the hydrogenation process to ions. The solvent is also of moderate coordinating ability such that it competes with carbon monoxide for the transition metal. A low carbon monoxide pressure causes the complex molecule form of the catalyst to dissociate into a transition metal cation and a transition metal, carbonyl anion. This ionic form of the catalyst is preferentially extracted into the dissociating solvent at the lower carbon monoxide pressure within the separator. The preferred dissociating solvent is ethylene glycol or mixtures of ethylene glycol and up to 20% by weight water. The combination of ethylene glycol and the catalyst draws the suspended particles of mineral matter into the glycol phase for subsequent separation. In addition to ethylene glycol, various other hydroxylic liquids which are immiscible with the coal liquid are expected to be suitable for use. These other liquids include propylene glycol, glycerol, diethanolamine and triethanolamine.

The catalyst used is a transition metal, carbonyl catalyst, for instance dicobalt octacarbonyl $Co_2(CO)_8$, molybdenum hexacarbonyl $Mo(CO)_6$, dimanganese decacarbonyl $Mn_2(CO)_{10}$, iron pentacarbonyl $Fe(CO)_5$ and triiron dodecacarbonyl $Fe_3(CO)_{12}$. Of these transition metal carbonyls, $Co_2(CO)_8$ is preferred as it has exhibited good catalytic activity, but it is reasonable to assume that some catalytic activity and recoverability would be exhibited by these other transition metal, carbonyl catalysts.

Within the system the catalyst appears in two forms, the complex molecule dissolved within the coal liquid, e.g. $Co_2(CO)_8$, and the solvated ionic form, e.g. $Co^{+2}$ (solvated with ethylene glycol) and $Co(CO)_4^-$. The cobalt carbonyl catalyst transfers between the coal liquid as a complex molecule and the dissociating solvent in the solvated ionic form in response to the change in carbon monoxide pressure. The relatively high carbon monoxide pressure within the hydrogenator drives the catalyst into the coal liquid while the reduced carbon monoxide pressure within the separator permits the catalyst to dissociate into the ionic form which is preferentially soluble within the dissociating solvent. The following reaction is typical $$3/2[Co_2(CO)_8] \xrightarrow[\text{glycol}]{\text{ethylene}} [Co^{+2}(Co(CO)_4^-)_2] + 4CO$$

After reducing the carbon monoxide pressure in separator 23, the dissociating solvent with the catalyst settles or is otherwise separated from the hydrogenated coal liquid product 27. The solvent and catalyst is then recycled to the hydrogenator to again be included in an immiscible mixture with fresh coal liquid feed 13. Mineral matter and some of the solvent can be withdrawn at 30 and water washed to remove relatively clean ash and mineral solids 33 from the process. As described, water can be removed from the solvent by an evaporation or distillation operation at 37 and the solvent returned to the hydrogenator. Alternatively, where the solvent is ethylene glycol a fairly high percentage of water can be tolerated, e.g. up to 20 weight percent, such that intermittent evaporation of the water from the solvent is permissible.

In accordance with the invention the dissociating solvent is recycled into contact with fresh coal liquid for return of the catalyst to the process. Suitable adaptations can be made to operate the process either continuously as indicated or in batch steps. The feed into and discharge from both the hydrogenator and the separator can accordingly either be performed intermittently or continuously.

The following example is presented merely to illustrate operation of the present process.

EXAMPLE

About 200 volume parts of ethylene glycol containing about 5% water by weight is blended with about 1000 volume parts of coal liquid blended with product so as to have a density of 1.07 g/cc. The resulting immiscible liquid mixture is agitated in the presence of 30 MPa total pressure including carbon monoxide and hydrogen in a mole ratio of about 1:1 and a temperature of about 220° C. Sufficient $Co_2(CO)_8$ is added into the ethylene glycol phase to obtain about 1.7% by weight Co before filling into the hydrogenator. After hydrogenation for about 16 hours, the immiscible liquid mixture is passed through a separator where the carbon monoxide partial pressure is reduced to about 50 kPa at a total pressure of about 100 kPa (1 atmosphere). After settling for about 16 hours, the hydrogenated coal liquid is removed as an upper liquid phase as product and the more dense ethylene glycol phase with the catalyst in solvated ionic form is recycled to the hydrogenator. Ash and other mineral matter are drawn from the bottom of the glycol phase. Table I illustrates the upgrading of the coal liquid by the present process.

TABLE I

| | H/C | S % | N % | O % | Mineral matter | Viscosity mPa s 24° C. | Density g/cc 24° C. | Heating value J/kg |
|---|---|---|---|---|---|---|---|---|
| Coal liquid | 1.03 | 0.44 | 1.08 | 2.85 | 1.31 | 44.9 | 1.07 | $3 \times 10^7$ |
| Product | 1.13 | 0.35 | 0.67 | 1.35 | 0.35 | 37.1 | 1.045 | $3.2 \times 10^7$ |

It will be clear from the above that the present invention provides a process for the hydrogenation and upgrading of coal liquid through the use of a homogeneous catalytic reaction. The catalyst is recoverable in a dissociating solvent phase and conveniently returned to the hydrogenation step. Ethylene glycol used as a dissociating solvent with the catalyst provides the additional advantageous feature of selectively wetting and removing finely divided particles of mineral matter from the coal liquid product.

The embodiments of the invention in which an exclusive property or privilege is claimed are defined as follows:

1. A method of hydrogenating a coal liquid through use of a transition metal, carbonyl catalyst dissolved as a complex molecule in said coal liquid comprising:

mixing the coal liquid including said dissolved catalyst with a dissociating solvent selected from the group of hydroxylic liquids consisting of ethylene glycol, propylene glycol, glycerol, diethanolamine, triethanolamine and mixtures thereof, in the presence of a gas mixture including hydrogen to hydrogenate the coal liquid, said gas mixture including carbon monoxide at a first partial pressure of carbon monoxide gas during hydrogenation of said coal liquid, said dissociating solvent being immiscible with said coal liquid and being of moderate coordinating ability while sufficiently polar to solvate the transition metal as ions in solution at a second partial pressure of CO which is lower than said first partial pressure;

reducing the CO pressure from said first partial pressure to said second partial pressure after said hydrogenation to cause said catalyst dissolved in said coal liquid as a complex molecule to dissociate into transition metal ions within the dissociating solvent, separating the hydrogenated coal liquid as product from the dissociating solvent at said second partial pressure of CO; and recycling the dissociating solvent having transition metal ions to said mixing step to mix with fresh coal liquid at said first partial pressure of CO to reform the transition metal, carbonyl catalyst as a complex molecule in said coal liquid.

2. The method of claim 1 wherein said catalyst dissolved in said coal liquid as a complex molecule dissociates into a solvated transition metal cation and a transition metal, carbonyl anion within the dissociating solvent at said second partial pressure of CO.

3. The method of claim 1 wherein the transition metal carbonyl catalyst dissolved as a complex molecule in the coal liquid is dicobalt octacarbonyl.

4. The method of claim 1 wherein the transition metal ions within the dissociating solvent at the second partial pressure of CO include cobaltous cation complex and tetracarbonyl cobaltate anion.

5. The method of claim 1 wherein the dissociating solvent has a higher density than the hydrogenated coal liquid.

6. The method of claim 1 wherein said dissociating solvent includes ethylene glycol.

7. The method of claim 6 wherein said dissociating solvent is an ethylene glycol-water mixture containing up to 20% by weight water.

8. The method of claim 6 wherein the coal liquid includes solid particles of mineral matter which are preferentially drawn into the dissociating solvent containing the catalyst and are separated from the solvent by a solid-liquid separation.

9. The method of claim 8 wherein the mineral matter separated from the dissociating solvent is washed with water to remove said solvent, the resulting water and solvent solution is concentrated by evaporation of water and the solvent is recycled into contact with fresh coal liquid at the first partial pressure of carbon monoxide.

10. The method of claim 1 wherein the first partial pressure of carbon monoxide gas is 10 to 50 MPa and the second partial pressure of carbon monoxide gas is 50 to 500 kPa.

* * * * *